United States Patent [19]

Steel

[11] Patent Number: 5,068,836

[45] Date of Patent: Nov. 26, 1991

[54] SOUND GENERATING TRANSDUCER

[75] Inventor: Geoffrey Steel, Bristol, England

[73] Assignee: British Aerospace Public Limited Company, London, England

[21] Appl. No.: 584,932

[22] Filed: Sep. 19, 1990

[30] Foreign Application Priority Data

Oct. 6, 1989 [GB] United Kingdom ..... 8922581

[51] Int. Cl.[5] ..... H04R 17/00

[52] U.S. Cl. ..... 367/174; 367/162; 367/163; 367/166; 367/171; 367/176; 181/182; 310/337

[58] Field of Search ..... 367/162, 176, 166, 171, 367/163, 174; 310/337, 334; 181/182, 160

[56] References Cited

U.S. PATENT DOCUMENTS.

| | | | |
|---|---|---|---|
| 4,413,198 | 11/1983 | Bost | 310/324 |
| 4,549,631 | 10/1985 | Bose | 181/155 |
| 4,628,528 | 12/1986 | Bose et al. | 381/90 |

FOREIGN PATENT DOCUMENTS

| | | |
|---|---|---|
| 0062401 | 10/1982 | European Pat. Off. . |
| 0215657 | 3/1987 | European Pat. Off. . |
| 0243591 | 11/1987 | European Pat. Off. . |
| 8302364 | 7/1983 | PCT Int'l Appl. . |
| 2187361 | 9/1987 | United Kingdom . |
| 2206262 | 12/1988 | United Kingdom . |

*Primary Examiner*—Deborah L. Kyle
*Assistant Examiner*—J. Woodrow Eldred
*Attorney, Agent, or Firm*—Cushman, Darby & Cushman

[57] ABSTRACT

A flextensional sonar transducer comprising a first cavity defined by an elliptical shell and end plates covering the two ends of the shell, vibration drive means inside the cavity and coupled between portions of the shell wall at opposite ends of the major axis of the shell, a further cavity connected to the first cavity and an opening between the two cavities for coupling the two cavities for the further cavity to affect the resonant frequency of the first.

7 Claims, 2 Drawing Sheets

SOUND GENERATING TRANSDUCER

BACKGROUND OF THE INVENTION

1. Field of the Invention

This invention relates to sound generating transducers, more particularly but not exclusively to so-called "Flextensional" sound generating transducers.

2. Description of the Related Art

One Flextensional sound generating transducer is disclosed in European patent specification No. 215657-A. It comprises an elliptical shell with end cover plates defining a cavity containing a stack of piezo-electric elements, the stack being compressed between portions of the shell wall at opposite ends of its major axis.

If the cavity is air-filled, it must be provided with pressure-resistant sealing, for example between the shell and cover plates, and the service depth of the transducer is in any case limited due to the increasing water pressure which acts on the sides of the shell to elongate it and reduce the stack compression. Compensation mechanisms, for example controllable wedges included in the stack, have been proposed but are complex and expensive.

On the other hand, if the transducer cavity is allowed to flood with liquid, the apparent stiffness of the shell increases along with its resonant frequency. This may be a disadvantage because the usefulness of a Flextensional transducer mainly is its ability to operate in a particular, relatively low, frequency range.

SUMMARY OF THE INVENTION

A free-flooding transducer is provided such that the cavity has an opening designed to act as a Helmholtz resonator at a frequency lower than the actual cavity or Flextensional resonance frequency. This proposal is effective except that the Helmholtz resonance peak is rather sharp so the bandwidth of such a transducer may be a little too narrow for some applications.

Thus, one object of the invention is to provide a sound generating transducer comprising a flooded cavity and for which the resonance frequency is in a desired low-frequency range and yet which has a wider bandwidth than the above-mentioned proposed transducer. A further object is to provide an alternative way of reducing the working frequency range of a flooded cavity transducer down nearer to the range associated with air-filled cavity transducers.

According to the invention there is provided, a sound generating transducer comprising a first cavity containing vibration generating means coupled to the cavity walls for vibrating the cavity and at least one further cavity coupled to the first for affecting the resonance frequency of the first cavity.

BRIEF DESCRIPTION OF THE DRAWINGS

For a better understanding of the invention, reference will be made, by way of example, to the accompanying drawings, in which.

DETAILED DESCRIPTION OF THE PREFERRED EMBODIMENTS

Figure 1:
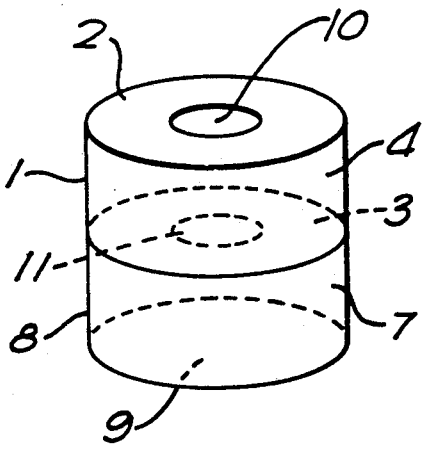
FIG. 1 is a diagrammatic perspective view of part of a flextensional transducer.
Figure 2:
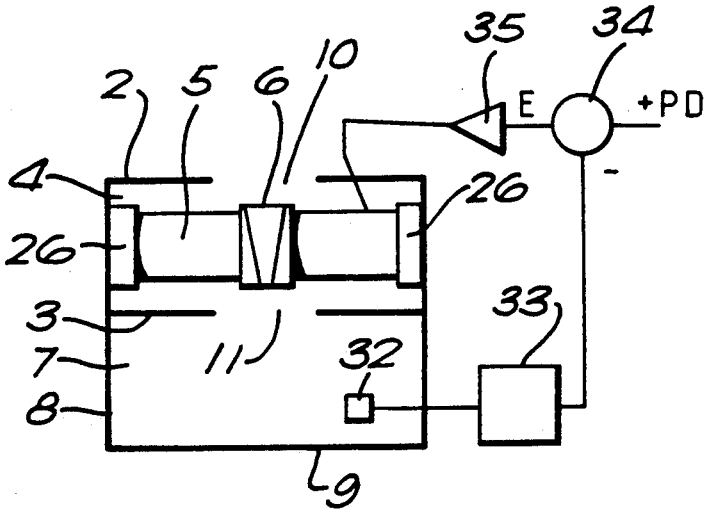
FIG. 2 is a diagrammatic sectional elevation of the FIG. 1 transducer.

The transducer of FIGS. 1 and 2 comprises an elliptical shell 1 and end-plates 2 and 3 defining a cavity 4 containing a piezo-electric stack 5 (shown in FIG. 2 only). At the ends of the stack, there are two D-shaped members 26 of which the curved surfaces engage shell wall portions at opposite ends of the major axis of the shell. The stack incorporates a central wedge mechanism 6 for pre-setting the stack compression. Connected end on to cavity 4, there is another cavity 7 defined by a second elliptical shell 8, end-plate 3 and a further end-plate 9. The end-plates 2 and 3 have respective apertures 10 and 11 to permit both cavities to flood with liquid. Apart from the liquid, the cavity 7 is empty. In this example the liquid will be sea-water, although oil or any other liquid may be suitable in other applications.

Figure 3:
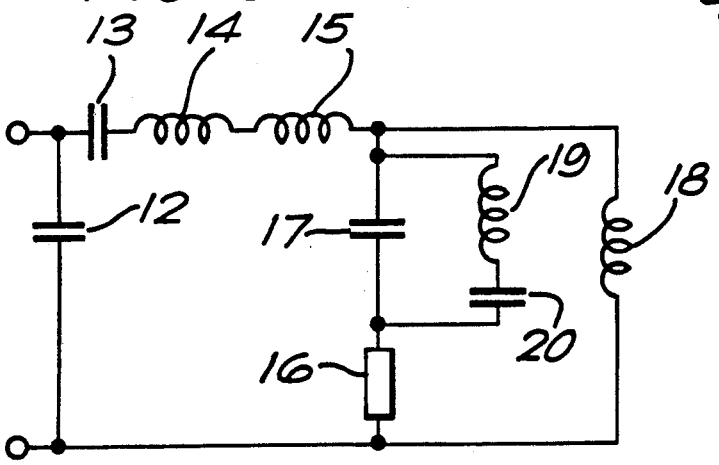
FIG. 3 is an equivalent circuit diagram for the FIG. 1 transducer.

The transducer can be represented by the equivalent electrical circuit diagram of FIG. 3. Here, the capacitance of parallel capacitor 12 and the series capacitor 13 and the inductance of series inductor 14 are presented to a drive signal fed into the transducer and are characteristic of the combination of the piezo-electric stack 5 and the shell 1. Inductor 15 and resistor 16 represent the components of the radiation impedance, i.e., they are characteristic of the ambient medium (sea-water here) into which and from which the sonar signal is sent and received. The capacitance of capacitor 17 is characteristic of the compliance of the cavity 4 and hence of its contents, i.e., its value would be different if the cavity 4 were to contain air rather than water, while the inductance of inductor 18 is characteristic of the aperture 10 and represents the so-called "inertance" of that aperture.

As will be appreciated by those skilled in the art, a closed, air-filled, single cavity transducer can be represented by an equivalent circuit diagram comprising only the components 12 to 17 in FIG. 3, but because the "compliance" of air is so much greater than that of water, the capacitance of capacitor 17 is increased in value to a point where it can be ignored. The resonance frequency of such a transducer is thus controlled by the values of the components 12 to 16. Providing an aperture in the single cavity transducer and allowing it to fill with water lowers the value of capacitance of capacitor 17 (hence raising the basic resonance frequency) and introduces the inductance component 18. That component generates a second resonance frequency and, as mentioned earlier, that second resonance frequency can be utilized if the aperture is arranged to place the second resonance frequency in a useful range. However, also as mentioned earlier, the second resonance peak is rather sharp. With the transducer of FIGS. 1 and 2 however, the provision of the second cavity 7 controls the basic resonance frequency to compensate for the reduced value of the compliance represented by capacitance of capacitor 17. In the equivalent circuit diagram, the result of the additional cavity is the introduction of an inductor 19 and a capacitor 20 connected in series with one another across the capacitor 17, the capacitance of capacitor 20 being particularly associated with the additional cavity 7 itself and the compliance of its contents, and the inductance of inductor 19 being characteristic of the aperture 11 through which the two cavities communicate.

To obtain useful effects from the addition of the cavity 7, its maximum internal dimension should be less than a quarter of the sonar signal wavelength at the resonance frequency and it should be as rigid as possible. It does not have to have the same elliptical shape as the actual flextensional cavity 4 (it could perhaps be cylindrical) although it may be convenient for it to have that same shape, and it does not have to be connected directly end on to the cavity 4, i.e., the two cavities could communicate via a duct of some suitable sort although, as will be appreciated, the greater the length of that duct, the greater will be the value of the inductance of inductor 19 in the equivalent circuit diagram - this sharpens the resonance peak and reduces bandwidth. The shell 8 and plate 9 making up the additional cavity 7 need not be of the same material (usually aluminium) as the shell and end-plates making up the Flextensional cavity 4 but, of course, the use of dissimilar materials may well cause corrosion problems so like materials are preferred.

Because the basic or Flextensional resonance is now being used and this is being controlled by the resonance of the second cavity, the Helmholtz resonance peak associated with the inductance component 18 and aperture 10 becomes irrelevant and, in theory, the aperture 10 could be closed. Cavities 4 and 7 may then contain any suitable liquid, i.e., sea-water or some liquid other than sea-water.

Figure 4:
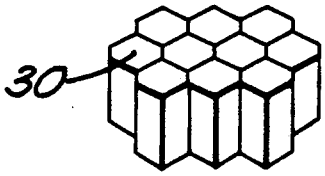
FIG. 4 is a perspective view of part of an arrangement of tube sections for damping dynamic pressure variations.

As well as the resonance frequency, the Q-value or sharpness of the resonance peak is also mainly controlled by inductance component 19 associated with aperture 11 and the capacitance of capacitor 20 associated with the compliance of cavity 7. The single aperture 11 could be replaced by two or more smaller apertures and each such aperture could have an arrangement of side-by-side tube portions, for example hexagonal tube portions 30 so that in cross-section the arrangement resembles a honeycomb as shown in FIG. 4, positioned therein to give a velocity dependent viscous damping of the flow of water through the aperture, this limits the dynamic pressure in the additional cavity and hence reduces the risk of cavitation.

The pressure in the additional cavity 7 provides a direct measure of the volume velocity (and thus power) in the acoustic load. This not only provides a means whereby the transducer may be calibrated but also enables its output to be regulated automatically by a feedback loop. Thus, as shown in FIG. 2, a pressure transducer (hydrophone) 32 can be mounted in cavity 7 and its output signal taken via a 90° phase shifter 33, to a summation point 34 where it is algebraically summed with a power demand signal PD, to produce an error signal E which is used to control drive amplifier 35 producing the drive signal for the stack.

Instead of only the one additional cavity 7, there could be two or more such cavities end to end with the Flextensional cavity and each other, and each having appropriate apertures for being flooded with water.

Figure 5:
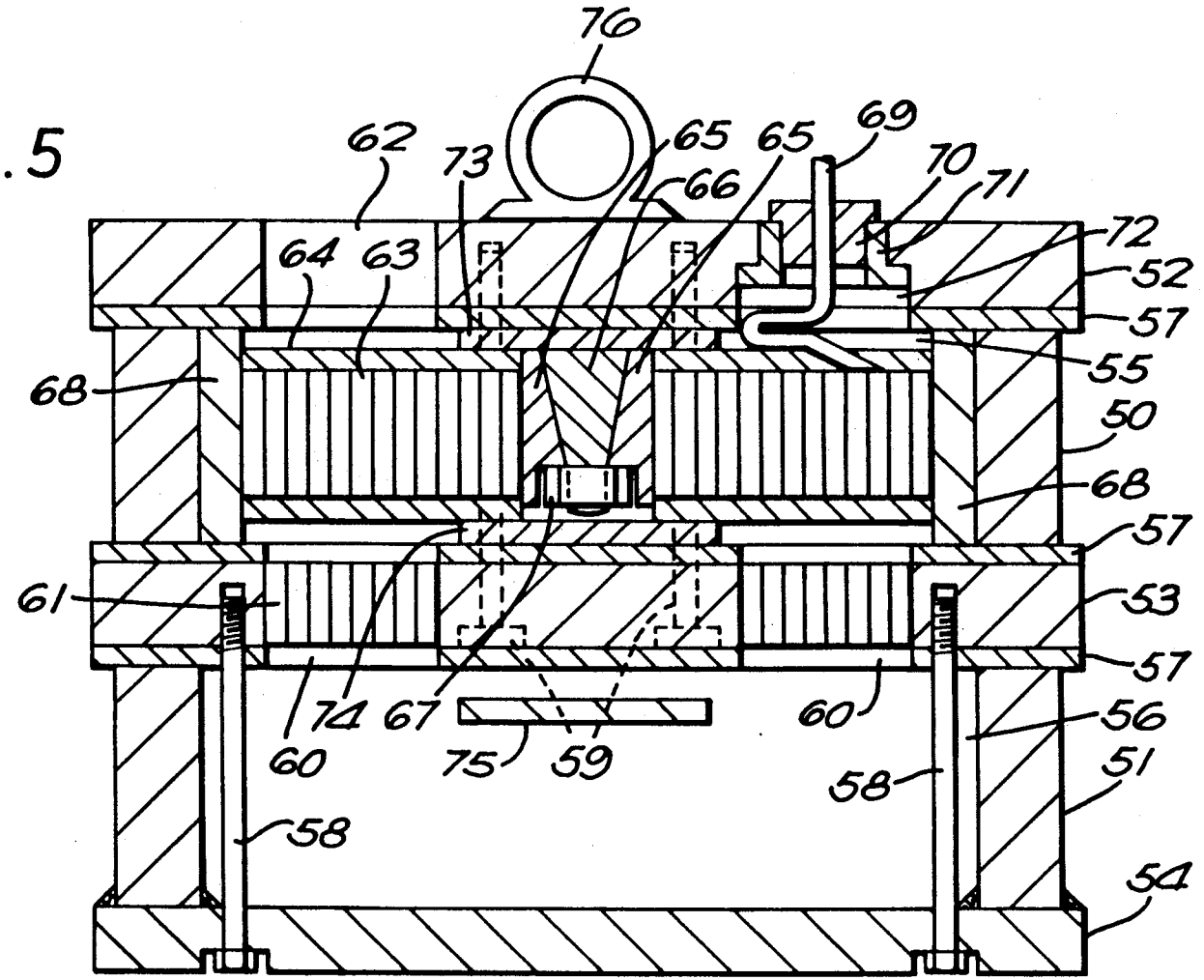
FIG. 5 is a sectional elevation of another Flextensional transducer.

The transducer of FIG. 5 comprises two elliptical shells 50 and 51, a top cover plate 52 positioned over the upper end of shell 50, a centre plate 53 positioned between the two shells, and a bottom cover plate 54 over the lower end of shell 51. There are thus defined an upper cavity 55 and a lower cavity 56. Sealing gaskets 57 are provided between the shell 50 and each plate 52 and 53, and between the shell 51 and plate 53. Bottom cover plate 54 is fillet welded inside and outside to the shell 51. Shell 51 and plate 54 are clamped to the centre plate 53 by bolts 58 (only two of which are visible) and the centre plate 53 and the top cover plate 52 are clamped together with the shell 50 between them by bolts 59. There are four of the bolts 59 and they are equispaced around and fairly close to the central axis of the shell 50—because of their positions only two of the bolts can be seen in FIG. 5 and then only in dashed outline.

The centre plate 53 has two apertures 60 each containing an arrangement of tube portions 61 as discussed earlier and shown in FIG. 4. The top plate 52 has an aperture 62 via which the cavity 55 becomes flooded. Cavity 56 is flooded via apertures 60 from cavity 55. Within cavity 55, there is a stack of piezo-electric elements 63 potted in insulating material 64 and incorporating a central wedge mechanism. The wedge mechanism comprises two outer members 65 and a wedge 66 having a screw-threaded portion at its narrow end on which is engaged a nut 67. By tightening the nut 67 against the edges of members 65, the wedge is drawn in between those members so as to adjust the stack compression. The ends of the stack engage the flat faces of respective D-shaped members 68 of which the curved faces engage portions of the shell 50 at opposite ends of its major axis. The drive signal cable 69 for the piezo-electric stack enters the cavity 55 via a gland 70 mounted in a plug member 71 in turn mounted in an aperture 72 in plate 52.

The stack is supported in its central region by the plates 52 and 53 acting through support members 73 and 74. It is desirable for any intermediate support for the stack to be positioned in the region of a vibratory node of the stack since then the support interferes less with the vibration. For the illustrated transducer, it is assumed there is such a node at the centre of the stack but, if that is not the case, then of course the arrangement of the support members may be varied to suit. In connection with the intermediate support of the stack, it will be appreciated that the seals 57 only have to seal against the dynamic pressures appearing within the cavities 55 and 56 not the relatively massive pressure due to the depth of immersion of the transducer in the water. As a result, the setting of the seals 57 is relatively uncritical and so the bolts 59 can be tightened and hence the spacing between plates 52 and 53 adjusted to achieve optimum support of the stack. With an air-filled transducer, the setting of the seals is the dominant factor and it is not really practicable to provide intermediate support for the stack.

The welding of shell 51 to plate 54 assists in maintaining rigidity of the lower cavity 56. To further assist this, a web 75 may be welded in place across the shell 51, i.e., so the web extends along the minor axis of the shell.

A lifting eye 76 is provided on top plate 52.

Instead of piezo-electric elements, the transducer could have magnetorestrictive drive elements.

I claim:

1. A Flextensional sonar transducer comprising a first cavity defined by an elliptical shell and end plates covering the two ends of the shell, vibration drive means inside the cavity and coupled between portions of the shell wall at opposite ends of the major axis of the shell, a second cavity connected to the first cavity and an opening between the two cavities for coupling the two cavities for the second cavity to affect the resonant frequency of the first cavity.

2. A transducer according to claim 1, including means for permitting the cavities to flood with water upon immersion of the transducer therein.

3. A Flextensional transducer according to claim 1, the vibration drive means comprising a stack of piezoelectric elements.

4. A Flextensional transducer according to claim 3, further comprising an adjustable wedge, disposed between two piezoelectric elements within the stack of piezoelectric elements, for adjusting compression of the stack.

5. A Flextensional transducer according to claim 1, the vibration drive means comprising magnetostrictive drive elements.

6. A Flextensional transducer according to claim 1, further comprising a plurality of hollow tubes disposed within the opening between the first cavity and the second cavity, the plurality of tubes coupling the first cavity to the second cavity.

7. A Flextensional transducer according to claim 1, further comprising:

control drive amplifier means, coupled to the vibration drive means, for providing an output to control the vibration drive means, and pressure transducer means, disposed in the second cavity and coupled to the control drive amplifier means, for providing a signal to regulate the output of the control drive amplifier means.

* * * * *